US006138563A

United States Patent [19]

Sone et al.

[11] Patent Number: 6,138,563

[45] **Date of Patent: *Oct. 31, 2000**

[54] DAMPENING WATER FEEDING METHOD AND APPARATUS

[75] Inventors: Yasuo Sone; Hiroyuki Yamamoto, both of Shizuoka, Japan

[73] Assignee: Baldwin-Japan, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/174,852

[22] Filed: Oct. 19, 1998

[30] Foreign Application Priority Data

Oct. 22, 1997 [JP] Japan ..... 9-309194

[51] Int. Cl.[7] ..... B41L 23/02

[52] U.S. Cl. ..... 101/147; 101/148; 101/484; 101/350.1; 101/DIG. 45

[58] Field of Search ..... 101/147, 148, 101/425, 484, 207, 208, 209, 210, DIG. 45, 483, 350.1, 363, 364, 365, 366

[56] References Cited

U.S. PATENT DOCUMENTS

| | | | |
|---|---|---|---|
| 3,700,984 | 10/1972 | Rouse | 101/148 |
| 4,064,801 | 12/1977 | Switall | 101/147 |
| 4,146,474 | 3/1979 | Kagatani | 101/147 X |
| 4,214,523 | 7/1980 | Mabrouk et al. | 101/148 |
| 4,469,024 | 9/1984 | Schwatz et al. | 101/147 |
| 4,649,818 | 3/1987 | Switall et al. | 101/148 |
| 4,972,774 | 11/1990 | MacPhee | 101/450.1 |
| 4,991,502 | 2/1991 | Akao | 101/148 |
| 5,038,681 | 8/1991 | Hultberg | 101/484 |
| 5,123,346 | 6/1992 | Schneider | 101/148 |
| 5,694,846 | 12/1997 | MacPhee | 101/148 |

FOREIGN PATENT DOCUMENTS

| | | |
|---|---|---|
| 0 355 571 | 2/1990 | European Pat. Off. . |
| 0 422 365 | 4/1991 | European Pat. Off. . |
| 2 129 437 | 10/1972 | France . |

OTHER PUBLICATIONS

European Search Report dated Jan. 26, 1999.

*Primary Examiner*—John S. Hilten
*Assistant Examiner*—Minh H. Chau
*Attorney, Agent, or Firm*—Morgan &Finnegan, LLP

[57] ABSTRACT

There is disclosed a method of feeding a dampening water to a plate cylinder in an offset printing press which is accelerated to, operated at and then decelerated from a predetermined speed for printing. The method comprises the step of programmatically controlling the feeding amount of the dampening water to increase in accordance with the increase in speed of the printing press along a first curve which is predetermined to indicate the relation of the feeding amount of dampening water to the speed of printing press, when the printing press is accelerated. The method further comprises the step of programmatically controlling the feeding amount of the dampening water to decrease in accordance with the decrease in speed of the printing press along a second curve which is predetermined to indicate the relation of the feeding amount of dampening water to the speed of printing press, when the printing press is decelerated. The first and second curves being different in feeding amount of the dampening water from each other.

9 Claims, 3 Drawing Sheets

DAMPENING WATER FEEDING METHOD AND APPARATUS

BACKGROUND OF THE INVENTION

1. Field of the Invention

The invention relates to a method of feeding a dampening water to a plate cylinder in an offset printing press, and an apparatus therefor.

2. Description of Related Art

In an offset printing press, there has been commercially available an apparatus for feeding a dampening water to a plate cylinder, as disclosed in Japanese Laid-Open Patent Publication No. 6863 of 1990. The apparatus may be a spray-type which includes a plurality of spray nozzles opposed to a fountain roller. The fountain roller is disposed in contact with a dampening roller. A supply of dampening water is connected to the spray nozzles through a plurality of solenoid operated valves to spray the dampening water onto the fountain roller. The fountain roller cooperates with the dampening roller to feed the dampening water to the plate cylinder. The printing press includes an equipment for feeding an ink to the plate cylinder, the dampening water preventing the ink from adhering to the plate, so that the ink will adhere to the plate selectively and partially for printing.

In the case, it is required that the dampening water corresponds in feeding amount to the ink. As to the feeding amount of ink, it is concerned with the speed of the printing press. On the other hand, the printing press is started at the beginning of printing to be accelerated to and operated at a predetermined speed. The printing press is then decelerated from the predetermined speed to be stopped at the end of printing. The ink increases and decreases in feeding amount in accordance with the increase and decrease in speed of the printing press when the printing press is accelerated and decelerated. In this connection, it is required to conveniently control the feeding amount of the dampening water so that the dampening water increases and decreases in feeding amount in accordance with the increase and decrease in speed of the printing press when the printing press is accelerated and decelerated, to correspond in feeding amount to the ink.

Under the circumstances, an attempt is made to establish a characteristic curve C0 which is predetermined to indicate the relation of the feeding amount of dampening water to the speed of printing press, as shown in FIG. 3. At the beginning of printing, the printing press is accelerated to a predetermined speed between points S1 and S2. The apparatus conveniently controls the feeding amount of the dampening water so that the dampening water increases in feeding amount in accordance with the increase in speed of the printing press along the characteristic curve C0, to correspond in feeding amount to the ink. The printing press is then operated at the predetermined speed for printing. The point S1 represents the speed in rotation of the plate cylinder of about 500 rpm to print about 120,000 news papers per hour. The point S2 represents the speed in rotation of the plate cylinder of about 420 rpm to print about 100,000 news papers per hour. The news paper has a length of 456 cm. At the end of printing, the printing press is decelerated from the predetermined speed. The apparatus conveniently controls the feeding amount of the dampening water so that the dampening water decreases in feeding amount in accordance with the decrease in speed of the printing press along the same curve C0, to correspond in feeding amount to the ink. The printing press is accelerated and decelerated gradually at the beginning and end of the printing for adjustment to print clearly and not to dirty the product with excess ink.

In the case, the printing press prints 2,000 to 3,000 news papers at a time when accelerated or decelerated. In addition, the printing press is accelerated and decelerated frequently whenever the printing press is stopped for a trouble and whenever certain country version plates are exchanged for other country version ones. Accordingly, it prints a large number of news paper in all when accelerated and decelerated.

However, the printing press can not have a high response in feeding amount of the ink, in particular with respect to the decrease in speed of the printing press when the printing press is decelerated. Accordingly, there may be a tendency to feed relatively more ink when the printing press is decelerated, resulting in lack of the dampening water. This causes dirt of news paper to waste many materials. On the contrary, it may be required according to the kind of ink and news paper material to feed relatively more dampening water, in particular when the printing press is accelerated, to rapidly remove the dirt of paper and minimize the waste of material.

It is therefore an object of the invention to provide a new and improved method of feeding a dampening water to a plate cylinder in an offset printing press, and an apparatus therefor, to overcome the above problems.

Another object of the invention is to minimize the waste of material due to lack of dampening water when the printing press is accelerated and decelerated.

SUMMARY OF THE INVENTION

According to the invention, there is provided a method of feeding a dampening water to a plate cylinder in an offset printing press. The printing press is accelerated to, operated at and then decelerated from a predetermined speed for printing.

The method comprises the step of programmatically controlling the feeding amount of the dampening water to increase in accordance with the increase in speed of the printing press along a first curve which is predetermined to indicate the relation of the feeding amount of dampening water to the speed of printing press, when the printing press is accelerated. The method further comprises the step of programmatically controlling the feeding amount of the dampening water to decrease in accordance with the decrease in speed of the printing press along a second curve which is predetermined to indicate the relation of the feeding amount of dampening water to the speed of printing press, when the printing press is decelerated. The first and second curves are different in feeding amount of the dampening water from each other.

The first and second curves may be different in feeding amount of the dampening water from each other within a predetermined range of speed lower than a normal printing speed.

In a preferred embodiment, the second curve is predetermined to feed the dampening water more than the first curve so as to compensate for lack of the dampening water within the predetermined range when the printing press is decelerated.

In other embodiment, the first curve is predetermined to feed the dampening water more than the second curve so as to compensate for lack of the dampening water within the predetermined range when the printing press is accelerated.

According to the invention, there is also provided an apparatus for feeding a dampening water to a plate cylinder in an offset printing press which is accelerated to, operated at and then decelerated from a predetermined speed for printing.

The apparatus comprises a detector for detecting the speed of the printing press to generate a detecting signal. The apparatus further comprises a controller by which first and second curves are predetermined and stored to indicate the relation of the feeding amount of dampening water to the speed of printing press. The first and second curves are different in feeding amount of the dampening water from each other. The controller is arranged to programmatically control the feeding amount of the dampening water in response to the detecting signal so that the dampening water increases in feeding amount in accordance with the increase in speed of the printing press along the first curve when the printing press is accelerated. The dampening water decreases in feeding amount in accordance with the decrease in speed of the printing press along the second curve when the printing press is decelerated.

The apparatus may further comprise a switching means for manually switching the program from the first curve to the second curve when the printing press is decelerated.

The controller may be arranged to have two sets of first and second curves predetermined and stored. The second curve is predetermined to feed the dampening water more than the first curve in one of the sets, while the first curve is predetermined to feed the dampening water more than the second curve in the other set. The controller may be further arranged to have a single curve predetermined and stored so that the dampening water increases and decreases in accordance with the increase and decrease in speed of the printing press along the single curve when the printing press is accelerated and decelerated. In the case, the controller is arranged to select any one of the sets of first and second curves and the single curve to programmatically control the feeding amount of the dampening water in response to the detecting signal.

In a preferred embodiment, the apparatus further comprises spray means opposed to a fountain roller which is disposed in contact with a dampening roller, and valve means through which a supply of dampening water is connected to the spray means to spray the dampening water onto the fountain roller. The fountain roller can cooperate with the dampening roller to feed the dampening water to the plate cylinder. The controller is connected to the valve means to programmatically control the feeding amount of the dampening water by opening and closing the valve means in response to the detecting signal.

In other embodiment, a brush roller is engaged with a fountain roller which is partially immersed in a pan of dampening water. The brush roller and the fountain roller are opposed to a dampening roller and rotated by a drive to splash the dampening water onto the dampening roller so that the dampening roller can feed the dampening water to the plate cylinder. The controller is connected to the drive to programmatically control the feeding amount of the dampening water by adjusting the speed of rotation of the brush roller and the fountain roller in response to the detecting signal.

DETAILED DESCRIPTION OF THE PREFERRED EMBODIMENTS

Figure 1:
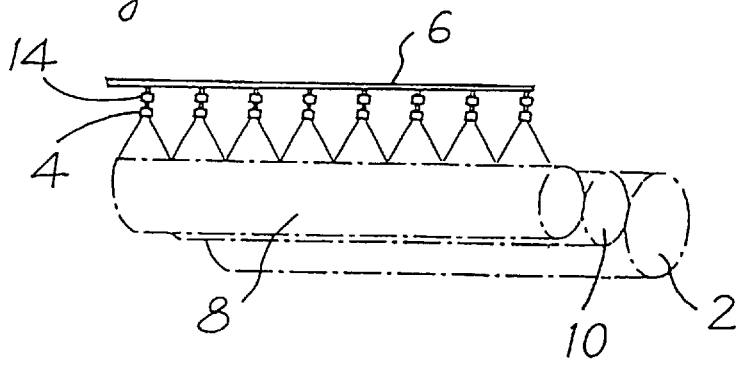
FIG. 1 is a schematically perspective view of a preferred embodiment of the invention.
Figure 2:
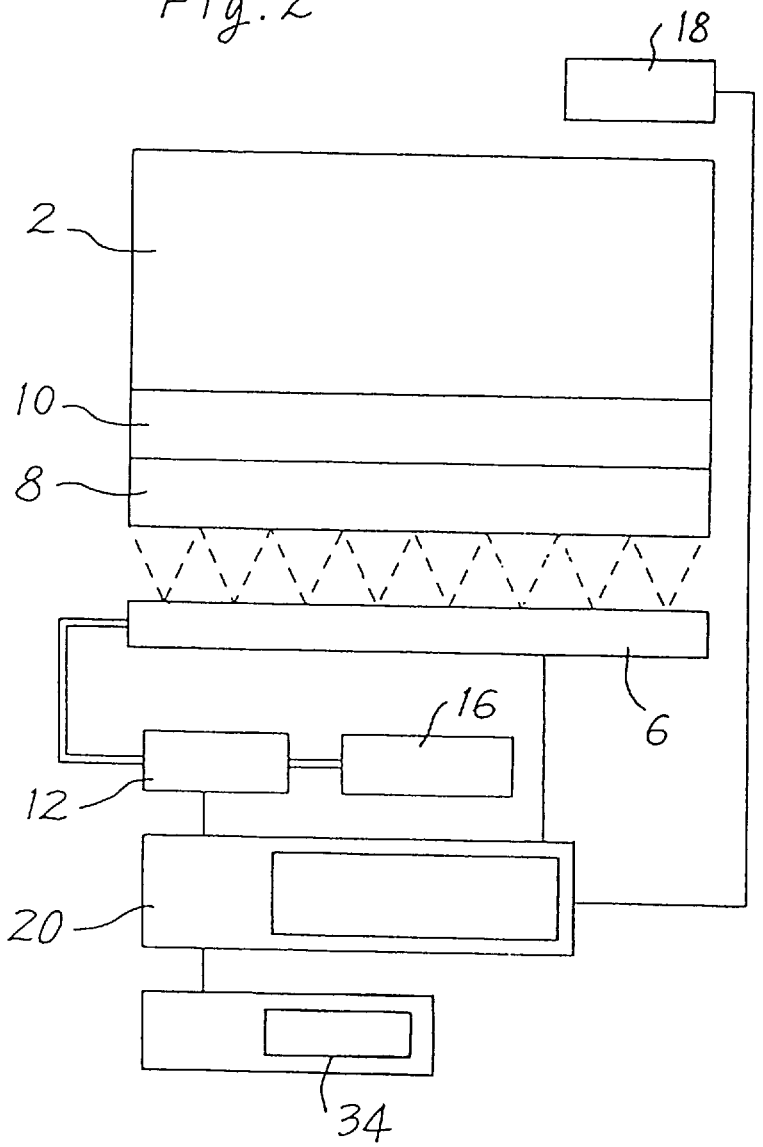
FIG. 2 is a block diagram of the elements in the apparatus of FIG. 1.

Turning now to the drawings, FIG. 1 illustrates an apparatus for feeding a dampening water to a plate cylinder 2 in an offset printing press, according to the invention. The plate cylinder 2 has a diameter of 348 mm and a length of 1640 mm to print news papers. The apparatus is a spray-type including spray means which comprises a plurality of spray nozzles 4 mounted on a bar 6 and opposed to a fountain roller 8. The fountain roller 8 is disposed in contact with a dampening roller 10 which is disposed in contact with the plate cylinder 2. The apparatus further includes a supply of dampening water comprising a pump 12, and valve means comprising a plurality of solenoid operated valves 14 through which the pump 12 is connected to the bar 6 and the spray nozzles 4 to spray the dampening water onto the fountain roller 8, as shown in FIG. 2.

Accordingly, the fountain roller 8 cooperates with the dampening roller 10 to feed the dampening water to the plate cylinder 2. The dampening water contains a little additive such as isopropyl alcohol mixed therewith. The printing press includes an equipment for feeding an ink to the plate cylinder 2, the dampening water preventing the ink from adhering to the plate, so that the ink will adhere to the plate selectively and partially for printing. The apparatus further includes a regulator 16 for measuring the specific gravity or pH of dampening water to regulate the density of the additive in the dampening water. The regulator 16 may regulate the temperature of the dampening water and filtrate impurities out of the dampening water.

Figure 4:
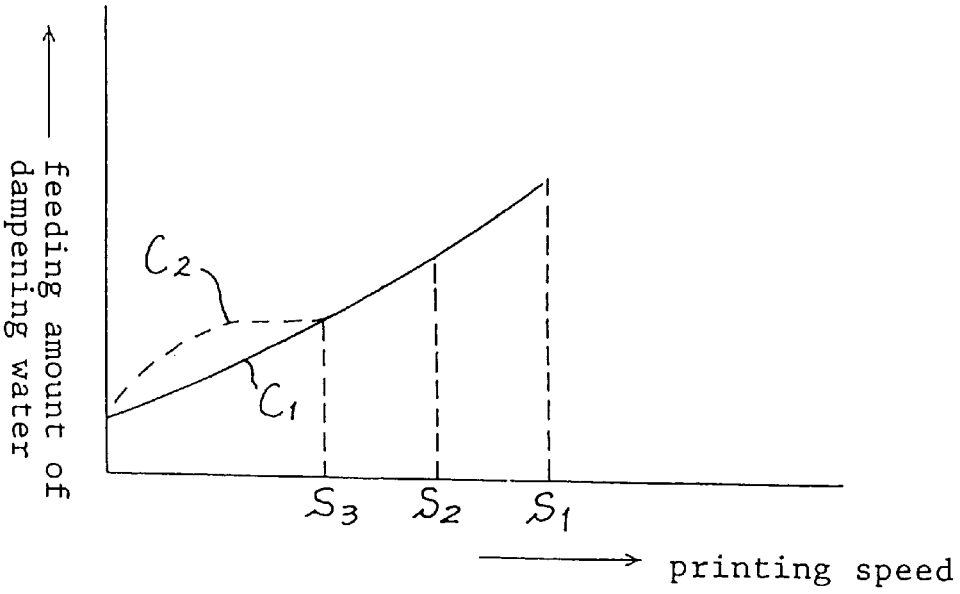
FIG. 4 is a graph showing the feeding amount of dampening water in the apparatus in FIG. 1.

The printing press is started at the beginning of printing to be accelerated to and operated at a predetermined speed. The printing press is then decelerated from the predetermined speed to be stopped at the end of printing. The ink increases and decreases in feeding amount in accordance with the increase and decrease in speed of the printing press when the printing press is accelerated and decelerated. In this connection, the apparatus includes a detector 18 for detecting the speed of the printing press to generate a detecting signal. The apparatus further includes a controller comprising a computer 20 by which first and second curves C1 and C2 are predetermined and stored to indicate the relation of the feeding amount of dampening water to the speed of printing press, as shown in FIG. 4. The first and second curves C1 and C2 are different in feeding amount of the dampening water from each other.

The controller 20 is connected to the solenoid operated valves 14 and arranged to programmatically control the feeding amount of the dampening water by opening and closing the solenoid operated valves 14 in response to the detecting signal from the detector 18, so that the dampening water increases in feeding amount in accordance with the increase in speed of the printing press along the first curve C1 when the printing press is accelerated. The dampening water decreases in feeding amount in accordance with the decrease in speed of the printing press along the second curve C2 when the printing press is decelerated.

By the way, the printing press is accelerated to and operated at a predetermined speed or normal printing speed between points S1 and S2. The printing press prints about 120,000 news papers per hour, the apparatus feeding the dampening water at an amount of about 300 ml per minute, at the point S1. The printing press prints about 100,000 news papers per hour, the apparatus feeding the dampening water at an amount of about 250 ml per minute, at the point S2. The printing press is then decelerated from the predetermined speed.

In this connection, it is preferable to programmatically control the feeding amount of the dampening water to increase and decrease in accordance with the increase and decrease in speed of the printing press along the same curve for adjustment, when the printing press prints the news papers at the high speed of 120,000 to 100,000 per hour, and when the printing press prints the news papers at a considerable speed near to the high speed of 100,000 per hour. Accordingly, the first and second curves C1 and C2 are different in feeding amount from each other within a predetermined range of speed lower than the predetermined speed or normal printing speed. For example, the predetermined range is limited by a point S3 lower than the normal printing speed. The printing press prints the news paper at a speed of 40 to 70%, preferably 50 to 60%, of the normal printing speed at the point S3. In the embodiment, the printing press prints about 60,000 news papers per hour at the point S3.

In addition, in the embodiment, the printing press has not a high response in feeding amount of the ink, in particular with respect to the decrease in speed of the printing press when decelerated so that there is a tendency to feed relatively more ink when the printing press is decelerated. In this connection, the second curve C2 is predetermined to feed the dampening water more than the first curve C1. Accordingly, the apparatus feeds relatively more dampening water to compensate for lack of the dampening water and print the news papers finely within the predetermined range when the printing press is decelerated, minimizing the waste of material due to lack of dampening water.

Figure 5:
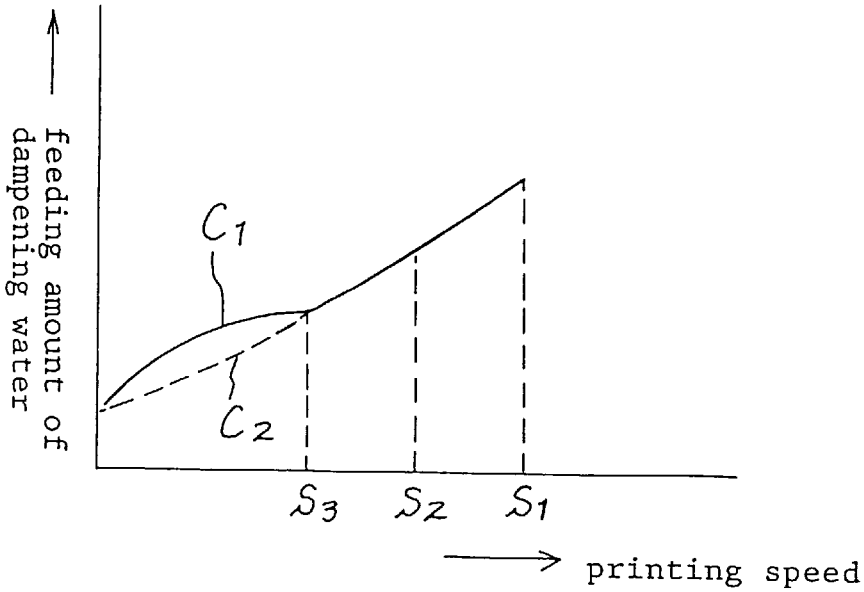
FIG. 5 is a graph showing the feeding amount of dampening water in other embodiment.

If it is required according to the kind of ink and news paper material to feed relatively more dampening water, in particular when the printing press is accelerated, the first curve C1 may be predetermined to feed the dampening water more than the second curve C2, as shown in FIG. 5. In the case, the apparatus feeds relatively more dampening water to compensate for lack of the dampening water within the predetermined range when the printing press is accelerated, rapidly removing the dirt of paper and minimizing the waste of material.

Figure 6:
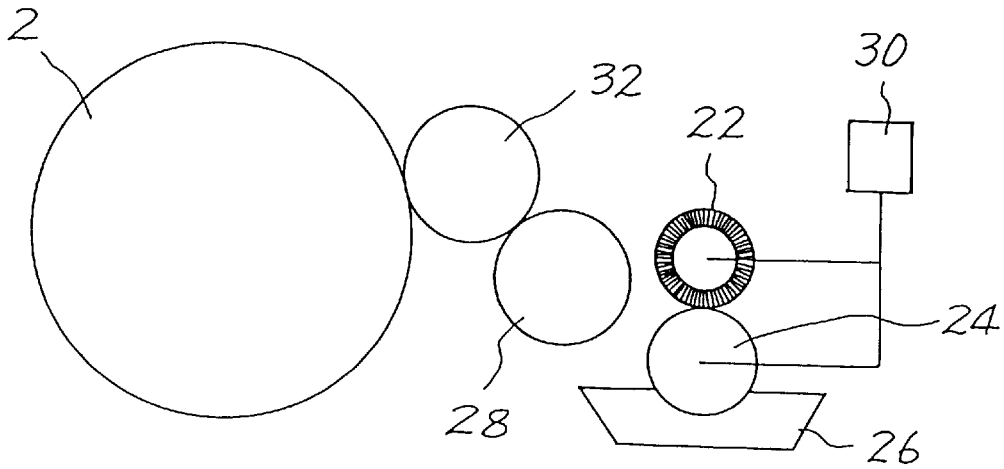
FIG. 6 is a schematically side view of other embodiment.

In other embodiment shown in FIG. 6, a brush roller 22 is engaged with a fountain roller 24 which is partially immersed in a pan 26 of dampening water. The brush roller 22 and the fountain roller 24 are opposed to a dampening roller 28 and rotated by a drive 30 to splash the dampening water onto the dampening roller 28. The dampening roller 28 is disposed in contact with a dampening roller 32 which is disposed in contact with the plate cylinder 2 so that the dampening roller 28 cooperates with the dampening roller 32 to feed the dampening water to the plate cylinder 2. The controller 20 is connected to the drive 30 and arranged to programmatically control the feeding amount of the dampening water by adjusting the speed of rotation of the brush roller 22 in response to the detecting signal from the detector 18, so that the dampening water increases in feeding amount in accordance with the increase in speed of the printing press along the first curve C1 when the printing press is accelerated. The dampening water decreases in feeding amount in accordance with the decrease in speed of the printing press along the second curve C2 when the printing press is decelerated.

The controller 20 automatically switches the program from the first curve C1 to the second curve C2 when the printing press is decelerated from the printing speed higher than the point S3. The apparatus may include a switching means 34 connected to the controller 20 to manually switch the program from the first curve C1 to the second curve C2 when the printing press is decelerated from the printing speed higher than the point S3.

Figure 3:
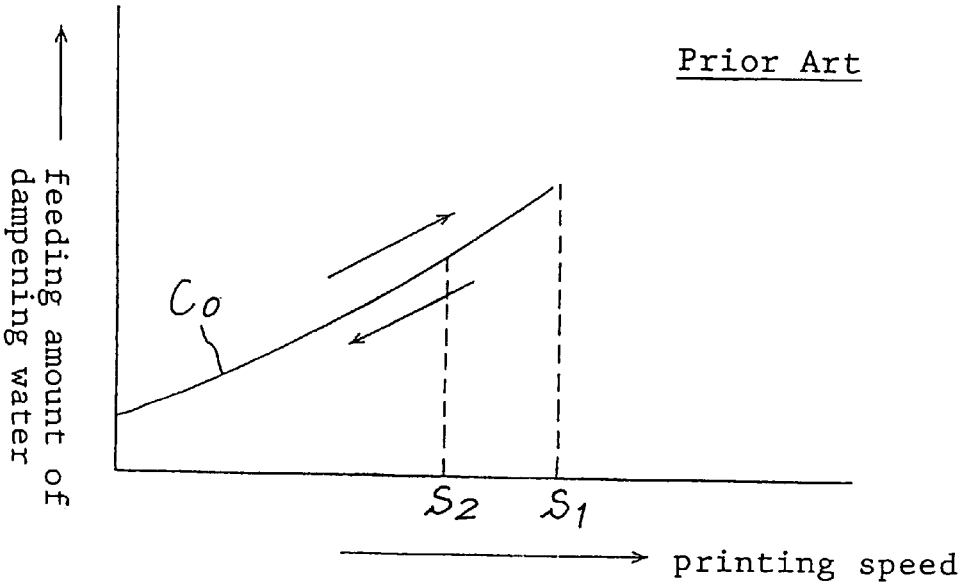
FIG. 3 is a graph showing the feeding amount of dampening water in prior art.

In addition, the controller 20 may be arranged to have two sets of first and second curves C1 and C2 predetermined and stored. The second curve C2 is predetermined to feed the dampening water more than the first curve C1 in one of the sets, as shown in FIG. 4, while the first curve C1 is predetermined to feed the dampening water more than the second curve C2 in the other set, as shown in FIG. 5. The controller 20 may be further arranged to have a single curve C0 predetermined and stored so that the dampening water increases and decreases in accordance with the increase and decrease in speed of the printing press along the single curve C0 when said printing press is accelerated and decelerated, as shown in FIG. 3. In the case, the controller 20 is arranged to select any one of the sets of first and second curves C1 and C2 and the single curve C0 to programmatically control the feeding amount of the dampening water in response to the detecting signal.

What is claimed is:

1. A method of feeding a dampening water to a plate cylinder in an offset printing press which is accelerated to, operated at and then decelerated from a normal printing speed, said method comprising the steps of:

making first and second curves available to said printing press, said first and second curves being predetermined to indicate the relation of the feeding amount of dampening water to the speed of printing press, said first and second curves being different in feeding amount of said dampening water from each other within a predetermined range of speed lower than and limited by a point which is lower than said normal printing speed, said printing press printing newspapers at a speed of 40 to 70% of the normal printing speed at said point, said first and second curves being united with each other at said point into a single curve;

establishing a program for controlling the feeding amount of said dampening water so that the dampening water increases in feeding amount in accordance with the increase in speed of said printing press along said first curve, when said printing press is accelerated; and automatically switching the program from said first curve to said second curve for controlling the feeding amount of said dampening water so that the dampening water decreases in feeding amount in accordance with the decrease in speed of said printing press along said second curve, when the printing press is decelerated from a printing speed higher than said point.

2. The method as set forth in claim 1 wherein said printing press prints newspapers at a speed of 50 to 60% of the normal printing speed at said point.

3. The method as set forth in claim 1 wherein said second curve is predetermined to feed the dampening water more than said first curve so as to compensate for lack of the dampening water within said predetermined range when said printing press is decelerated.

4. The method as set forth in claim 1 wherein said first curve is predetermined to feed the dampening water more than said second curve so as to compensate for lack of the dampening water within said predetermined range when said printing press is accelerated.

5. An apparatus for feeding a dampening water to a plate cylinder in an offset printing press which is accelerated to, operated at and then decelerated from a normal printing speed, said apparatus comprising:

a detector for detecting the speed of said printing press to generate a detecting signal; and a controller by which first and second curves are predetermined and stored to indicate the relation of the feeding amount of dampening water to the speed of printing press, said first and second curves being different in feeding amount of said dampening water from each other within a predetermined range of speed lower than and limited by a point which is lower than said normal printing speed, said printing press printing newspapers at a speed of 40 to 70% of the normal printing speed at said point, said first and second curves being united with each other at said point into a single curve, said controller having a program to control the feeding amount of said dampening water in response to said detecting signal so that the dampening water increases in feeding amount in accordance with the increase in speed of said printing press along said first curve, when said printing press is accelerated, said controller automatically switching the program from said first curve to said second curve to control the feeding amount of said dampening water in response to said detecting signal so that the dampening water decreases in feeding amount in accordance with the decrease in speed of said printing press along said second curve, when said printing press is decelerated from a printing speed higher than said point.

6. The apparatus as set forth in claim 5 wherein said printing press prints newspapers at a speed of 50 to 60% of the normal printing speed at said point.

7. The apparatus as set forth in claim 5 wherein said controller is arranged to have two sets of said first and second curves predetermined and stored, the second curve being predetermined to feed the dampening water more than the first curve in one of the sets, the first curve being predetermined to feed the dampening water more than the second curve in the other set, said controller being arranged to have a single curve predetermined and stored so that the dampening water increases and decreases in accordance with the increase and decrease in speed of said printing press along the single curve when said printing press is accelerated and decelerated, said controller being arranged to select any one of said sets of first and second curves and said single curve to control the feeding amount of said dampening water in response to said detecting signal.

8. The apparatus as set forth in claim 5 further comprising spray means opposed to a fountain roller which is disposed in contact with a dampening roller, and valve means through which a supply of dampening water is connected to said spray means to spray the dampening water onto said fountain roller so that said fountain roller can cooperate with said dampening roller to feed the dampening water to said plate cylinder, said controller being connected to said valve means to control the feeding amount of said dampening water by opening and closing of said valve means in response to said detecting signal.

9. The apparatus as set forth in claim 5 further comprising a brush roller engaged with a fountain roller which is partially immersed in a pan of dampening water, said brush roller and said fountain roller being opposed to a dampening roller and rotated by a drive to splash the dampening water onto said dampening roller so that said dampening roller can feed the dampening water to said plate cylinder, said controller being connected to said drive to control the feeding amount of said dampening water by adjusting the speed of rotation of said brush roller and said fountain roller in response to said detecting signal.

* * * * *